US006345478B1

(12) United States Patent
Pang

(10) Patent No.: US 6,345,478 B1
(45) Date of Patent: Feb. 12, 2002

(54) METHOD OF PARTITIONING OFFICE SPACES

(75) Inventor: Tak Him Pang, Hong Kong (HK)

(73) Assignee: Joinwide Investment Limited, Kowloon (HK)

( * ) Notice: Subject to any disclaimer, the term of this patent is extended or adjusted under 35 U.S.C. 154(b) by 0 days.

(21) Appl. No.: 09/496,055

(22) Filed: Feb. 2, 2000

(30) Foreign Application Priority Data

Feb. 19, 1999 (GB) ..... 9903700

(51) Int. Cl.[7] ..... E04B 1/00

(52) U.S. Cl. ..... 52/239; 52/238.1; 52/241; 52/242; 52/481.1; 52/482

(58) Field of Search ..... 52/238.1, 239, 52/241, 242, 481.1, 482

(56) References Cited

U.S. PATENT DOCUMENTS 3,436,885 A * 4/1969 Rothermel ..... 52/221
4,361,994 A * 12/1982 Carver ..... 52/238.1
4,733,509 A * 3/1988 Takahashi ..... 52/126.5
4,841,699 A * 6/1989 Wilson ..... 52/221

* cited by examiner

*Primary Examiner*—Carl D. Friedman
*Assistant Examiner*—Dennis L. Dorsey
(74) *Attorney, Agent, or Firm*—Oblon, Spivak, McClelland, Maier & Neustadt, P.C.

(57) ABSTRACT

A method of partitioning an office space includes providing an interlocking framework unit including at least one vertical framework configured to receive and support at least one partitioning material, at least one skirting framework configured to receive and support at least one partitioning material, at least one covering framework configured to receive and support at least one partitioning material, at least one window framework configured to receive and support at least one of at least one partitioning material and at least one window and at least one door framework configured to receive and support at least one of at least one partitioning material and at least one door; the interlocking framework unit being configured to form at least one internal conduit for plural cables between adjacent partitioning materials from a ceiling level through the at least one skirting framework positioned at a floor level when assembled and assembling the interlocking framework unit such that the at least one internal conduit is formed between the adjacent partitioning materials from the ceiling level through the at least one skirting framework positioned at a floor level.

31 Claims, 14 Drawing Sheets

METHOD OF PARTITIONING OFFICE SPACES

BACKGROUND OF THE INVENTION

1. Field of the Invention

This invention relates to a method of partitioning office space to create discrete and separate office units.

2. Discussion of The Background

At completion office buildings are usually in a bare shell condition. This requires the incoming occupant to design and implement its office layout. The creation of discrete office units on a floor has traditionally required the erection of a framework, usually made of steel, which is bolted to the floor, walls and the ceiling. Cables for electricity and telephones are then run from the ceiling through fixed metal conduits inside the framework to the floor level. On either side of the framework panels made of plasterboard or a similar material are attached by means of screws or other similar means of attachment. Holes are then cut into the plasterboard at the desired location to allow for installation of electricity and power sockets.

The disadvantage with the present method of creating and partitioning office space is that the ceiling and all the building service work, such as laying the electrical cables and the like, must be done prior to commencement of the partitioning work. Further the entire partitioning work must be carried out on site. The result of this is that partitioning of the office space can be delayed pending the completion of the building services work and, because the framework has to be created on site, partitioning can take several days to complete.

A further disadvantage of the present system is that once the partitioning has been installed any alteration to the office layout requires the entire partitioning to be disassembled before it can be relocated. This means all the panels and the framework have to be removed, as well as the fixed internal conduits for the cabling.

SUMMARY OF THE INVENTION

The present system of partitioning office space overcomes all these problems. An advantage of the present system is that the entire partitioning system, which incorporates a supporting framework and partitioning panels, are fully prefabricated off site. The prefabricated panels are then brought to the site for assembly. As the panels are fully prefabricated erection on site requires considerably less time than with the conventional system. The assembly of the entire partition system can take place in the office before any of the building services and/or the ceiling, have been put into place.

Further once the partitioning is installed the layout of the office can be changed quickly and easily without having to dismantle the entire partitioning. The entire prefabricated panels can be detached from the securing means holding them in place to the floor and to the wall and relocated as a unit.

The present invention utilizes a framework which, when assembled, creates an internal conduit between the adjacent partition panels, which can accommodate all cabling from the ceiling. This eliminates the need to fix conduits from the ceiling to the floor inside the framework. Accordingly cabling can be run down to the floor and thence to the appropriate sockets in the internal conduit between any of the adjacent partition panels. By virtue of the fact that the conduit for the cabling is built into the framework, the partition panels can be erected immediately.

According to the invention the partitioning system has five types of frameworks each of a different shape, to hold and support the partitioning panels, windows and/or doors. The different frameworks are designed so that when they are adjacent to each other they interlock to create a rigid framework.

The types of framework can be categorised as vertical framework, skirting framework, covering framework, window framework and door framework.

The vertical framework has a rectangular "U" shaped channel which has two members disposed perpendicular to the long edge of the rectangular "U" shaped channel on the internal surface, which create distinct channels within the "U" shaped channel and which also has an inverted "L" shaped member disposed at the top end of the short edges of the rectangle which creates an external channel capable of receiving partition panels. The vertical framework is provided with a means for interlocking the open face of the framework with the adjacent framework.

The skirting framework has a rectangular "U" shaped channel which has two members disposed perpendicular to the long edge of the rectangular "U" shaped channel on the internal face and which also has two "L" shaped members disposed on the external face of the long edge of the rectangular "U" shaped channel. The top of the short edge of the "U" shaped rectangular channel is disposed with two lips which create a channel into which a partition panel can sit. The bottom of the short edged of the "U" shaped channel has one lip which is used to secure a cover for the skirting framework. Cabling can thus be run along the length of the skirting framework within the "U" shaped rectangular channel.

The covering framework has a "U" shaped rectangular channel which has two members disposed perpendicular to the long, internal edge of the channel, which creates two channels. The covering framework can be used to secure the vertical framework to the wall and it can also be used to cover the horizontal face of the partitioning panels at the ceiling. The partitioning panels fit into the channels in the covering framework.

The window framework has a member with a broadly rectangular cross-section disposed with a wing at the top edge of either side of the member. The wings can receive either the open face of the vertical framework or the partition panels directly. A section of the top surface of the rectangular cross-section member is cut out so as to form a channel into which the glass for the window can be inserted. The rectangular cross-section member is provided with a means for interlocking the open face of the member with the adjacent framework.

The door framework has a member with broadly rectangular cross-section which is provided with a means for interlocking the open face of the member with the adjacent framework. A section of the top face of the rectangular cross-section member is cut out at either end of the member creating two recess, one of which can accommodate a partition panel. A member of a generally tubular cross-section is attached at the comer of the rectangular cross-section. The tubular cross-section member has a recess on the same face as the recesses on the rectangular cross-section member. This recess can also receive and accommodate a partition panel.

Each partition panel has two sheets of the partitioning panel placed parallel to each other with the vertical edge of the panels inserted into the "L" shaped member disposed at the edge of the "U" shaped rectangular channel of the vertical framework. The design of the vertical framework is such that when two partition panels are placed adjacent to each other to create the partition wall, the outer face of the vertical framework of each panel meets to form an interlocking, enclosed conduit which can accommodate cables from the ceiling. Horizontal or diagonal bracing members may be attached between the inner faces of the vertical framework, to provide additional support for the partitioning panels.

The bottom edge of the partition panel are inserted into the channels created on the top edge of the skirting framework. The skirting framework is attached to the bottom of the vertical framework by suitable attachment means and is provided with junction boxes at various points along its length to facilitate the installation of telephone, data and electricity sockets. The vertical framework is disposed with holes at a suitable location near the floor to allow the cabling from the vertical framework to pass into the skirting framework. Cabling from the ceiling is fed through the conduit created by the vertical framework, through the holes, into the "U" shaped channel in the skirting framework.

Where the layout of the office requires a window to be installed in the partition panel a hole is cut into the partition panel. If the window is the width of the partition panel, the partition panel is severed horizontally. The vertical and horizontal faces of the partition panels which form the space for the window may be enclosed by the vertical framework. The window framework which has the glass for the window in place is then connected to the open face of the vertical framework such that it interlocks with the vertical framework surrounding the window space. The vertical and horizontal faces of the partition panels which form the space for the window need not be enclosed by the vertical framework in which case the partition panels slot into the channels in the window framework.

Where the layout requires a door to be installed, the door framework of the appropriate size is connected to the open face of the vertical framework surrounding the door space such that it interlocks. The door can then be hinged to the door framework.

The partition panels are prepared off site in accordance with the design of the office layout. The prepared panels can then be brought to the site and installed where required in the office space and this can be done even before the wiring or the ceiling work has been completed.

In order to erect the partitioning in the office brackets are bolted on the floor and the wall. The brackets are disposed with retaining pins, which are perpendicular to the bracket. The retaining pins interlock with the channels in the vertical framework which receive the partitioning panels.

In order to secure the vertical framework to the wall the covering framework is attached to the wall.

BRIEF DESCRIPTION OF THE DRAWINGS

In order that the method of creating and partitioning office space can be more fully understood it will now be described by reference to the drawings.

DESCRIPTION OF THE PREFERRED EMBODIMENTS

Figure 1:
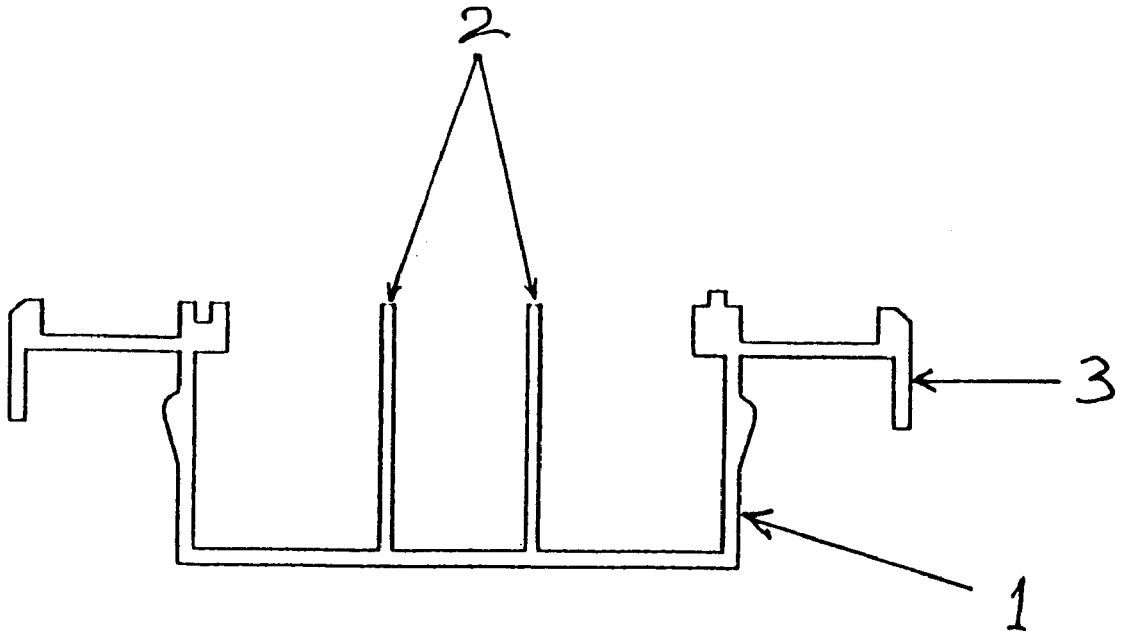
FIG. 1 is a transverse sectional view of the vertical framework.

The vertical framework (1) as seen in FIG. 1 has two members (2) disposed perpendicular to the long edge of the rectangular "U" shaped channel on the internal face and has two L shaped members (3) at either end of the long edge of the framework which form a recess within which the partition wall panels (13) sit.

Figure 6:
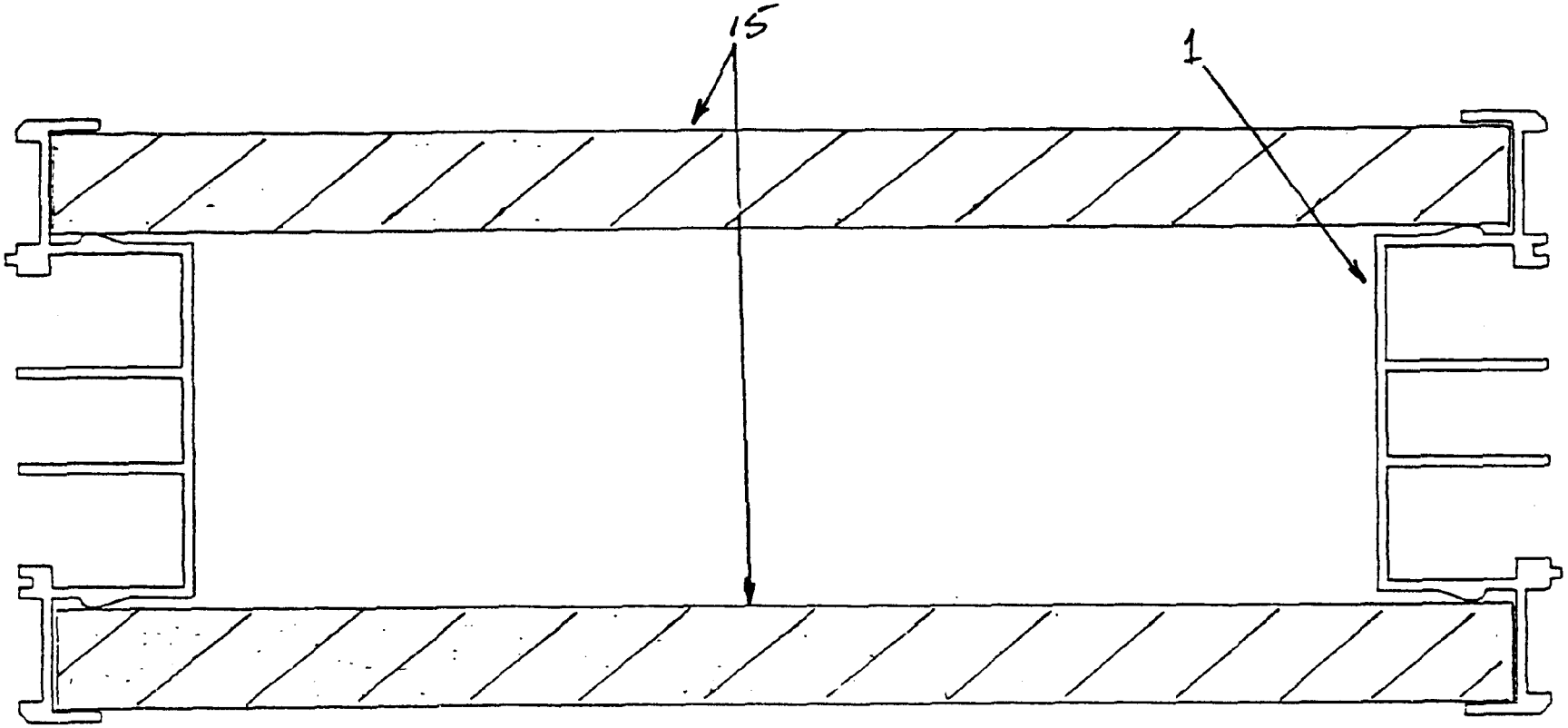
FIG. 6 is a transverse sectional view of a complete partition panel showing two partitioning panels placed parallel to each other with the vertical edges enclosed within the vertical framework.
Figure 7:
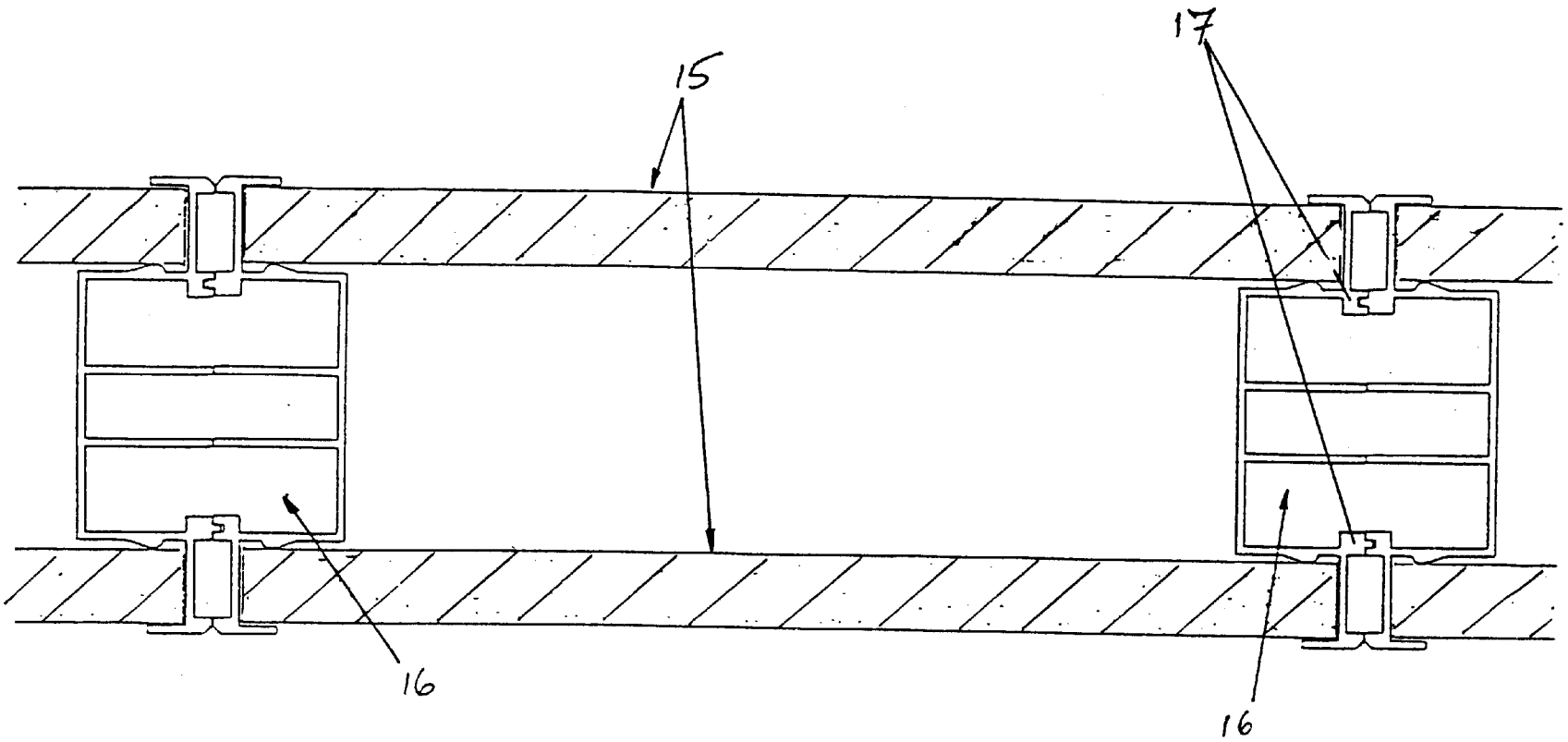
FIG. 7 is a transverse sectional view of three adjacent partition panels forming a partition wall.

The vertical face of each partition panel (15) is enclosed by the vertical framework (1) as can be seen in FIG. 6 such that the open face of the vertical framework is facing outward. Such partition panels sits adjacent to each other to form a partition wall as can be seen in FIG. 7, whereby the open faces of the vertical framework meet forming an interlocking joint (17) and create an internal vertical conduit (16) for cabling running from the ceiling to the skirting framework. The members of the vertical framework disposed perpendicular to the long edge of the "U" shaped rectangular channel (2) enable the formation of discrete channels within the internal conduit to separate power, data and telephone cables.

Figure 2:
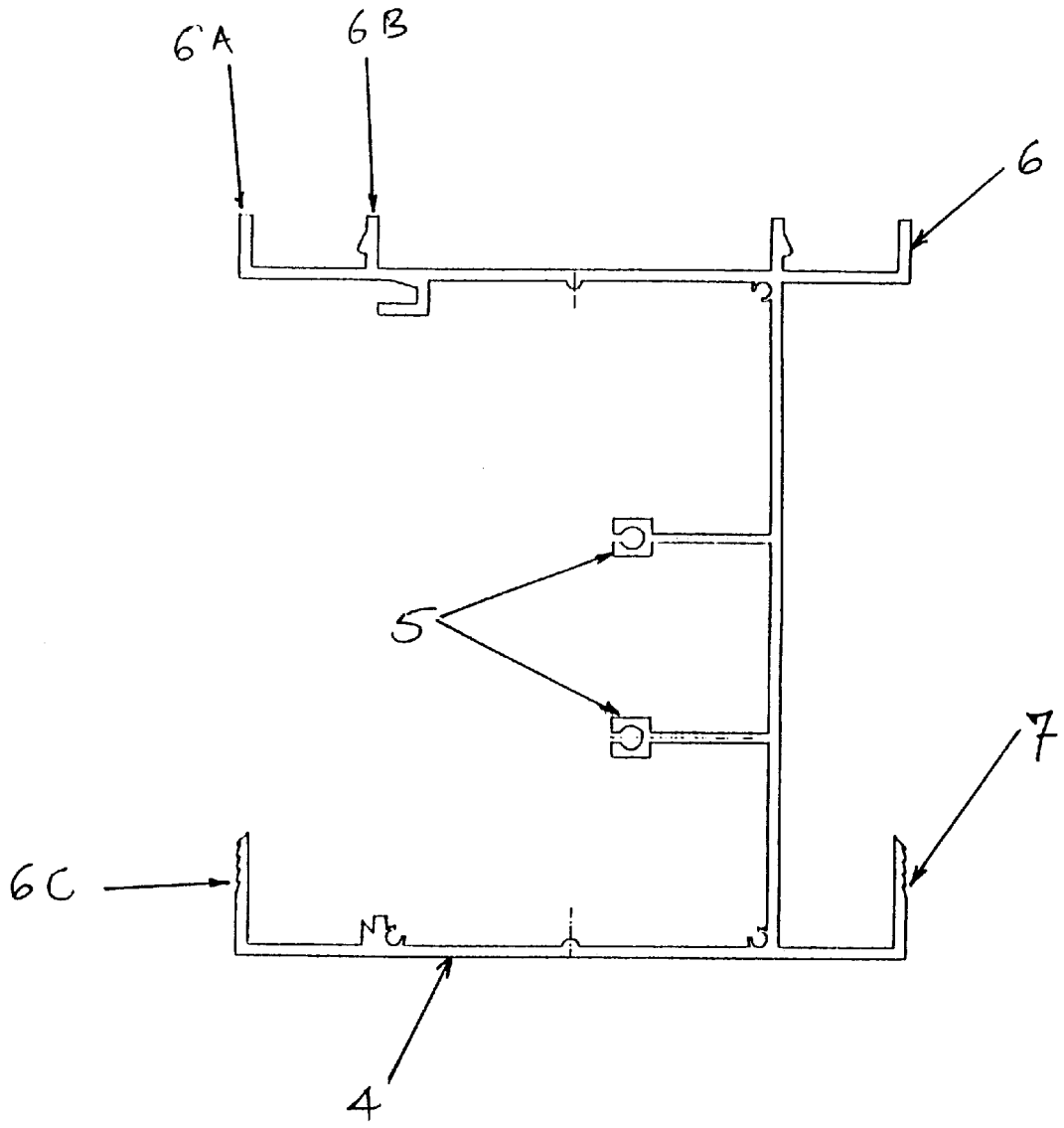
FIG. 2 is a transverse sectional view of the skirting framework.
Figure 13:
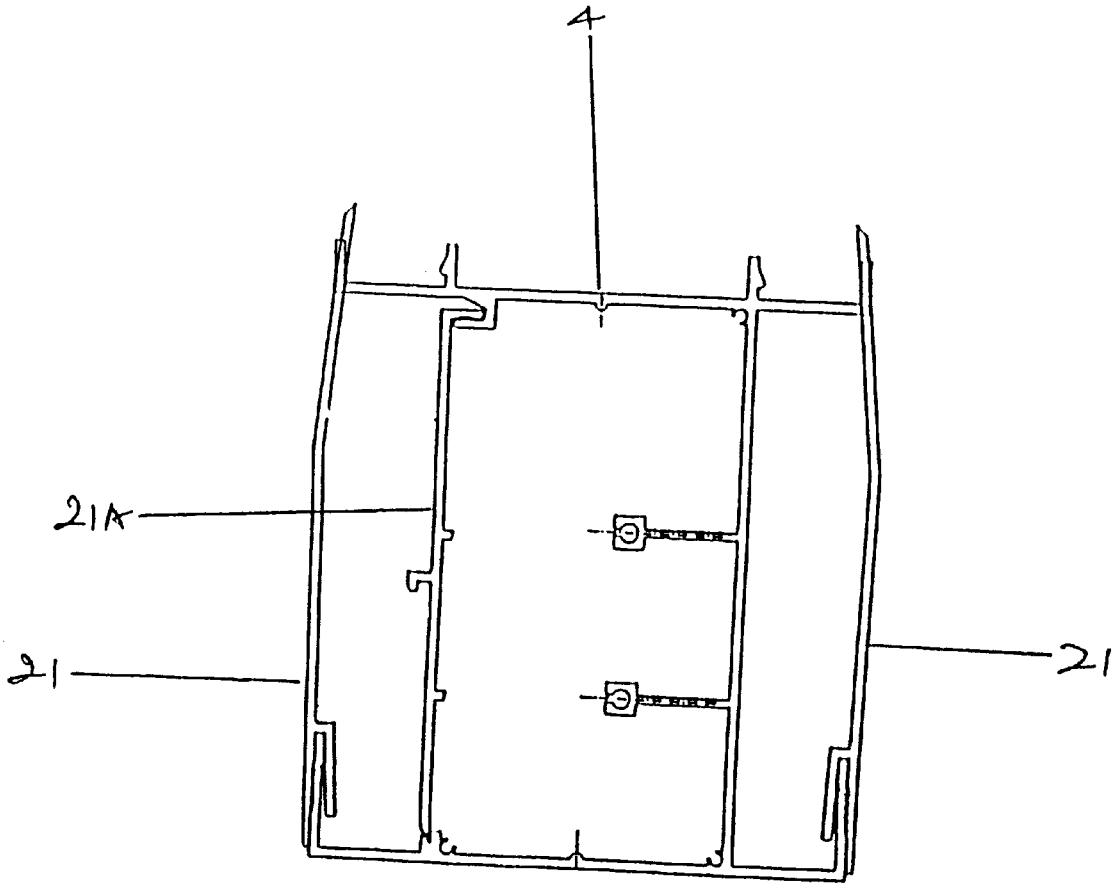
FIG. 13 is a longitudinal sectional view of the skirting framework attached to the floor.

The skirting framework as seen in FIG. 2 has a rectangular "U" shaped channel (4) which has an "L" shaped member forming a recess (6) at the top end of the vertical face of the skirting member such that a partition panel can sit within the recess and a further "L" shaped member forming a recess at the bottom end (7) of the vertical face of the skirting member to enable a skirting cover (21) to be attached as seen in FIG. 13. The top of the short edge of the skirting framework is disposed with two lips (6A and 6B) and the bottom edge is disposed with one lip (6C). The top lip creates a recess within which a partitioning panel can be accommodated. The lower lip enables a skirting cover (21) to be attached. The skirting framework is secured to the bottom of the vertical framework by suitable securing means.

A further cover (21A) as seen in FIG. 13 can be attached at the open face of the rectangular "U" shaped channel (4). Cables from the ceiling which are carried down to the floor via the internal conduits (16) in the vertical framework can be fed into the skirting framework via holes disposed in the vertical framework and from there be fed into junction boxes located at suitable intervals along the length of the skirting framework.

The members disposed perpendicular to the long edge of the "U" shaped channel (5) as seen in FIG. 2 enable the cables for electricity, data and telephones to be kept separate from each other while running along the skirting.

Figure 4:
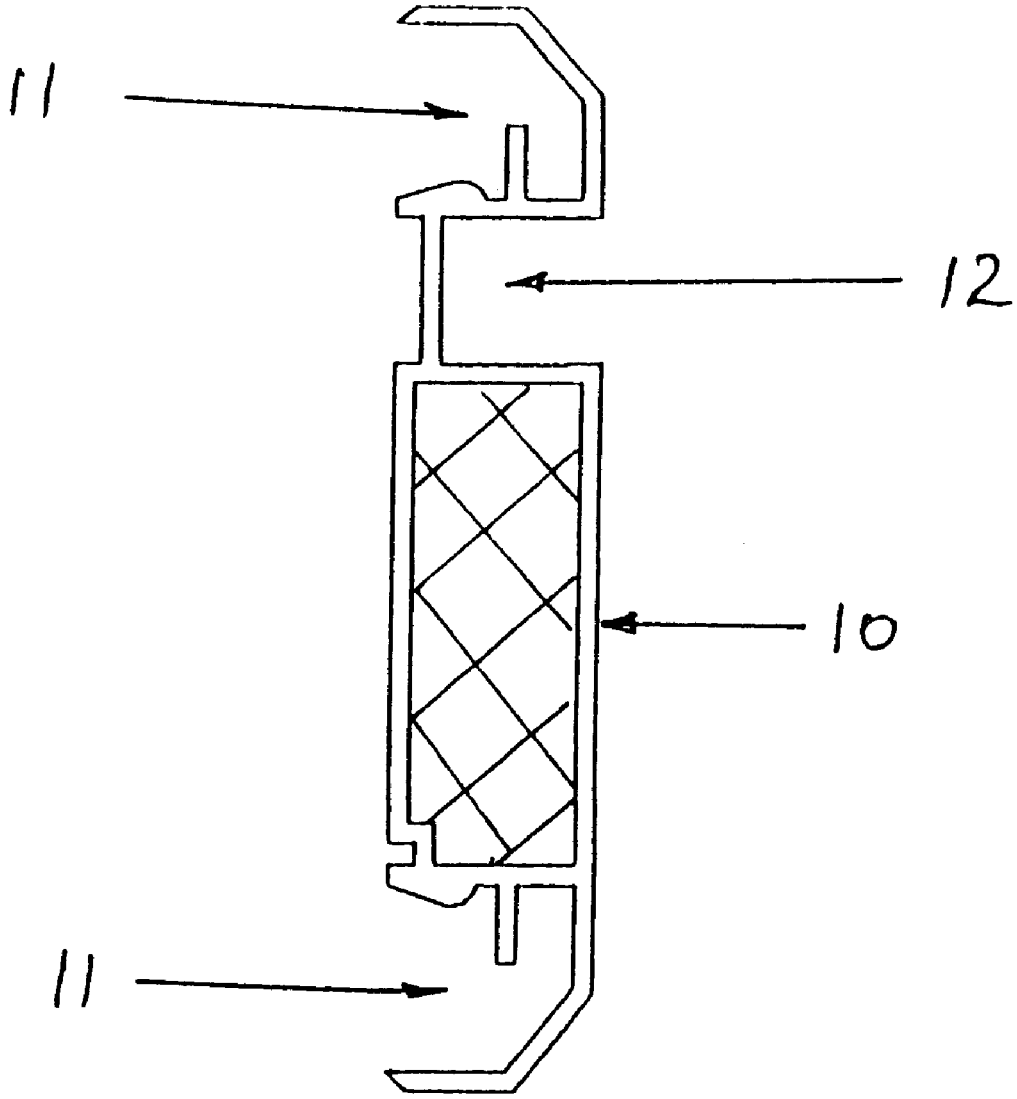
FIG. 4 is a transverse sectional view of the window framework.
Figure 8:
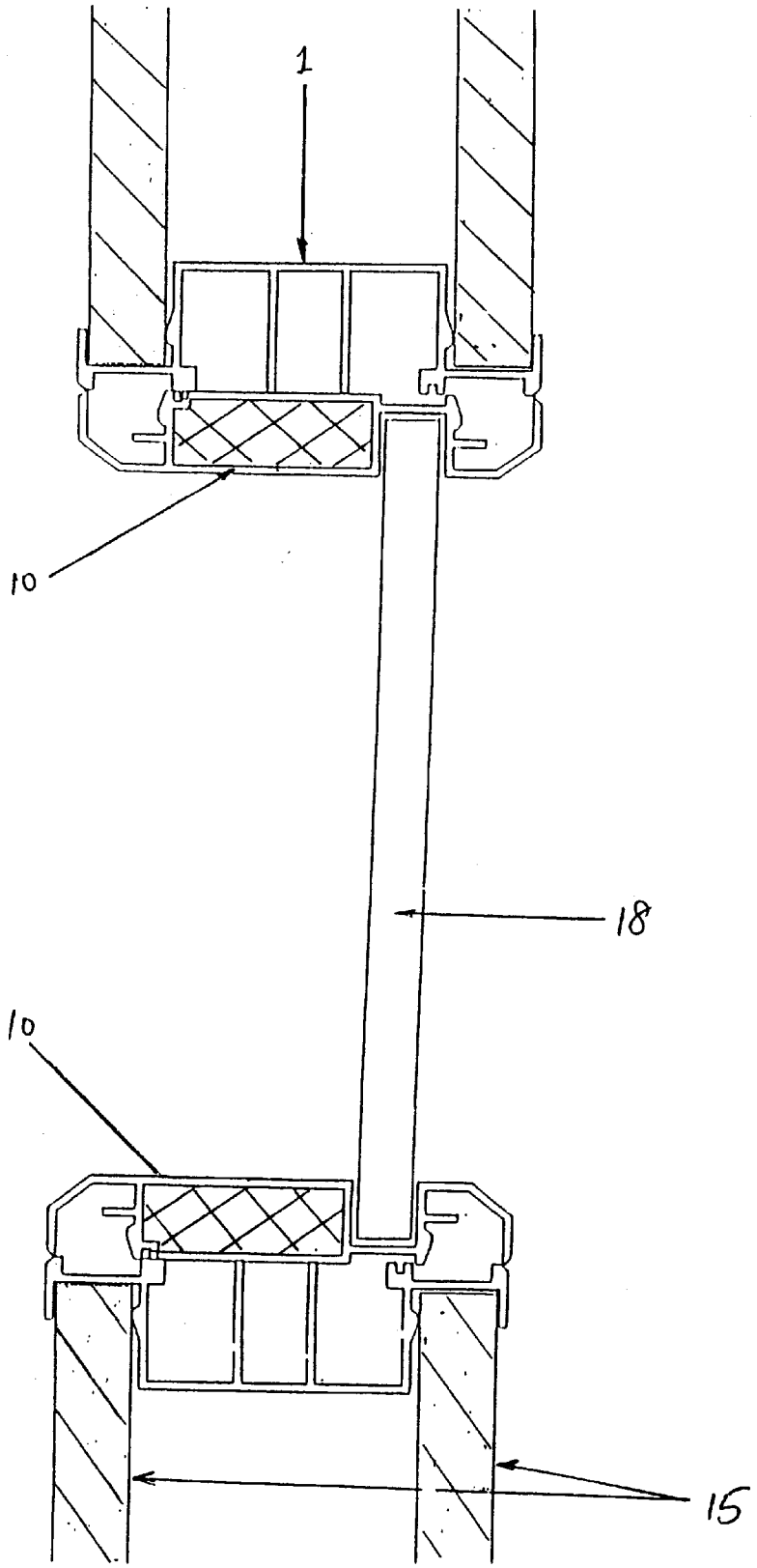
FIG. 8 is a transverse sectional view of a window between two adjacent partition panels enclosed by the vertical framework.
Figure 8A:
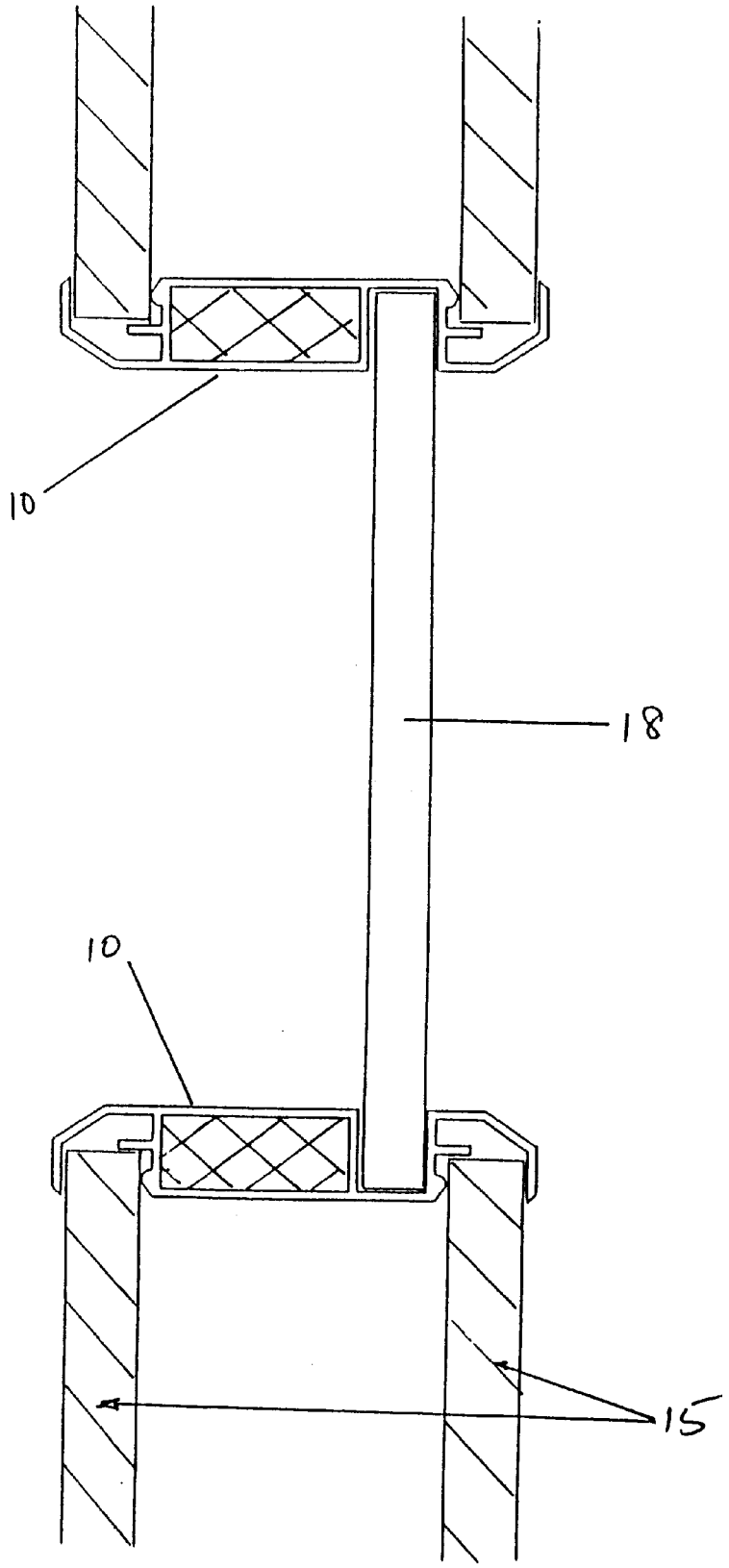
FIG. 8A is transverse sectional view of a window between two adjacent partition panels with the partition panels slotted directly into the window framework.
Figure 9:
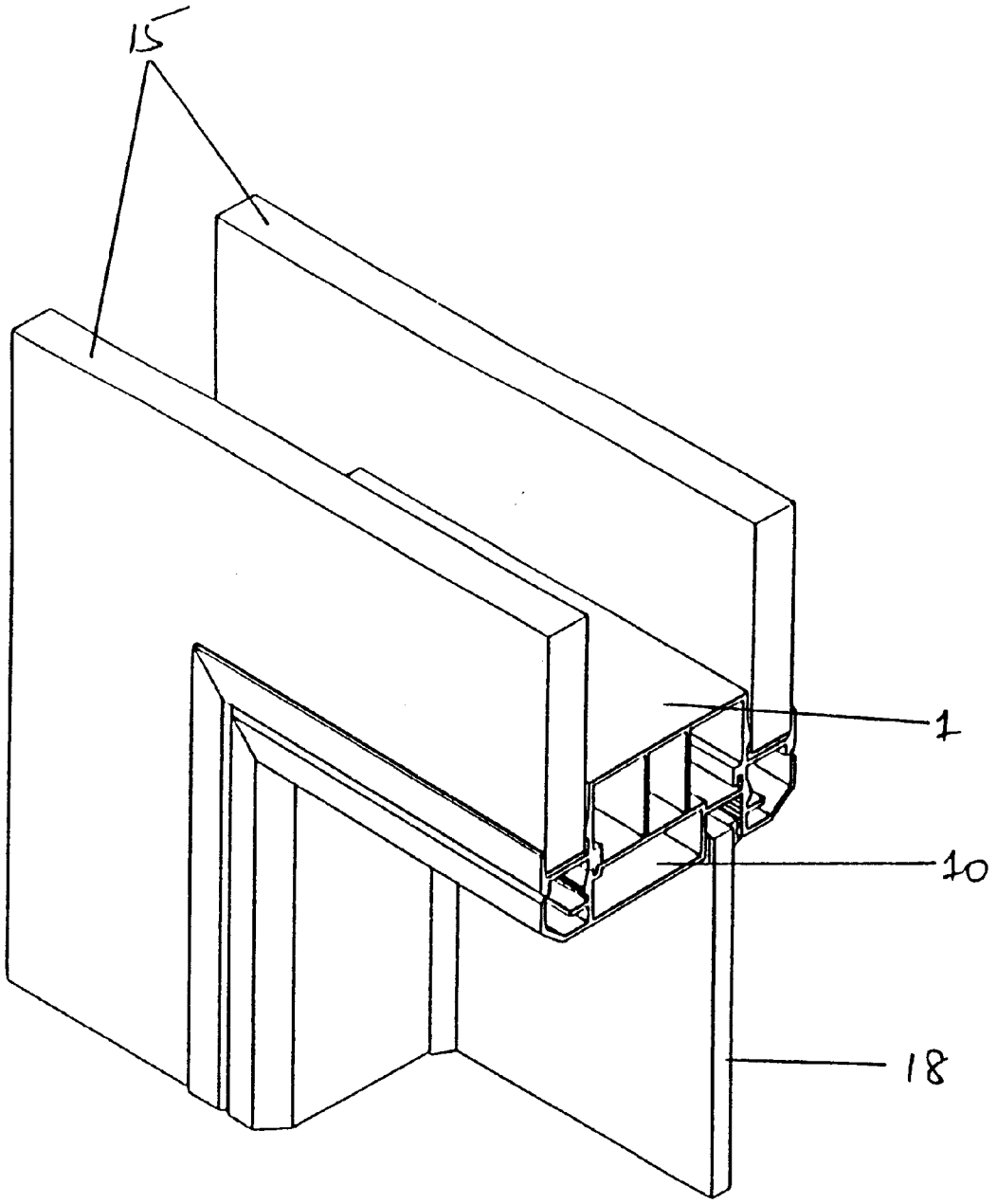
FIG. 9 is perspective view of a section of the window and partition panels.

The window framework (10),can be seen in FIG. 4 which shows the wings (11) creating the recess for the partition panels and the recess for the glass (12). The glass (18) which can be seen in FIGS. 8, 8A and 9 is in fact enclosed by the recess (12) on all four sides. The open face of the window framework created by the wings (11) can either interconnect with the open face of the vertical framework (1) which surrounds the opening for the window, as seen in FIG. 8, or can receive the partition panels directly as can be seen in FIG. 8A.

Figure 3:
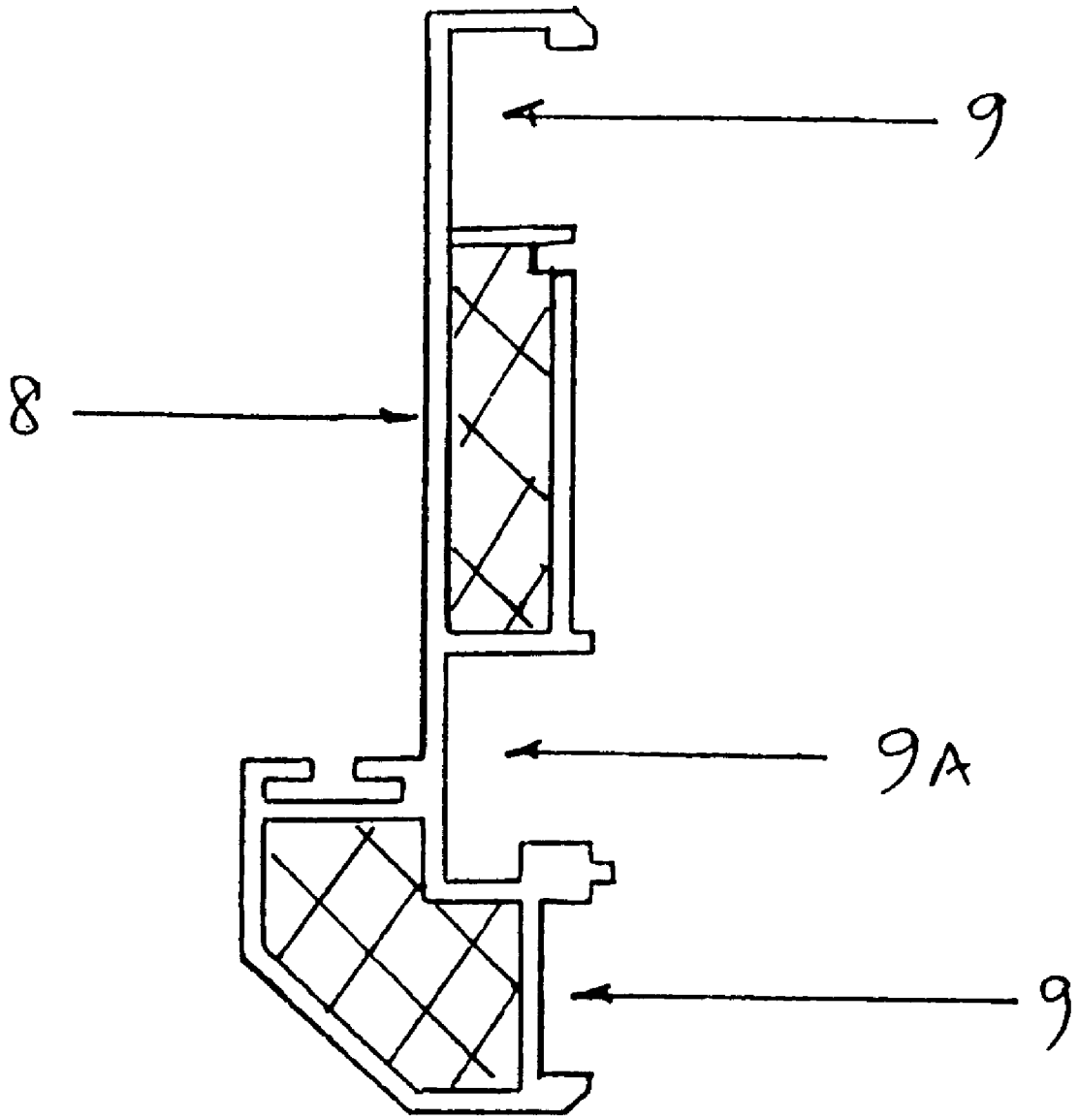
FIG. 3 is a transverse sectional view of the door framework cover.
Figure 10:
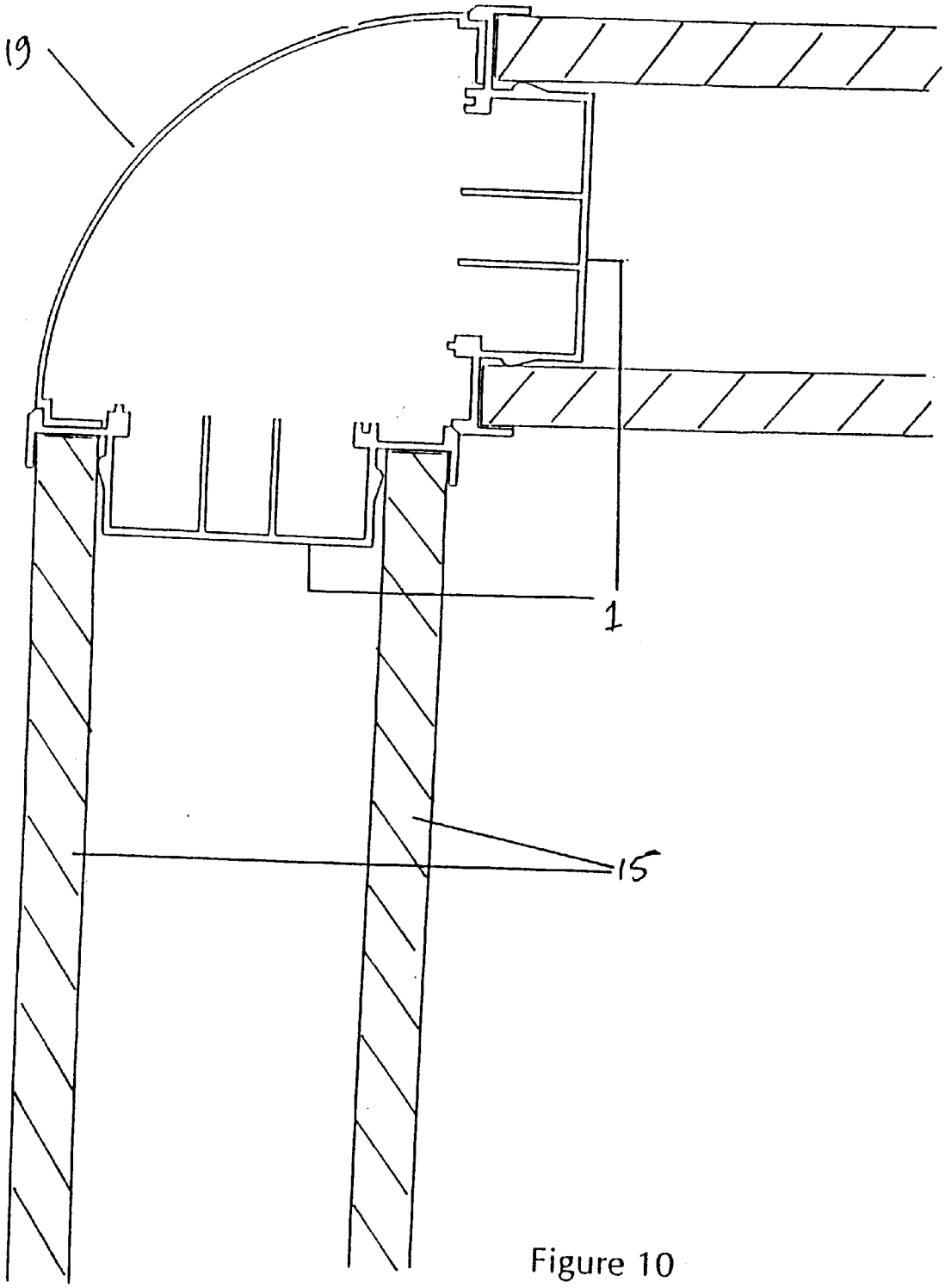
FIG. 10 is a transverse sectional view of the end of two partition panels at a corner.
Figure 11:
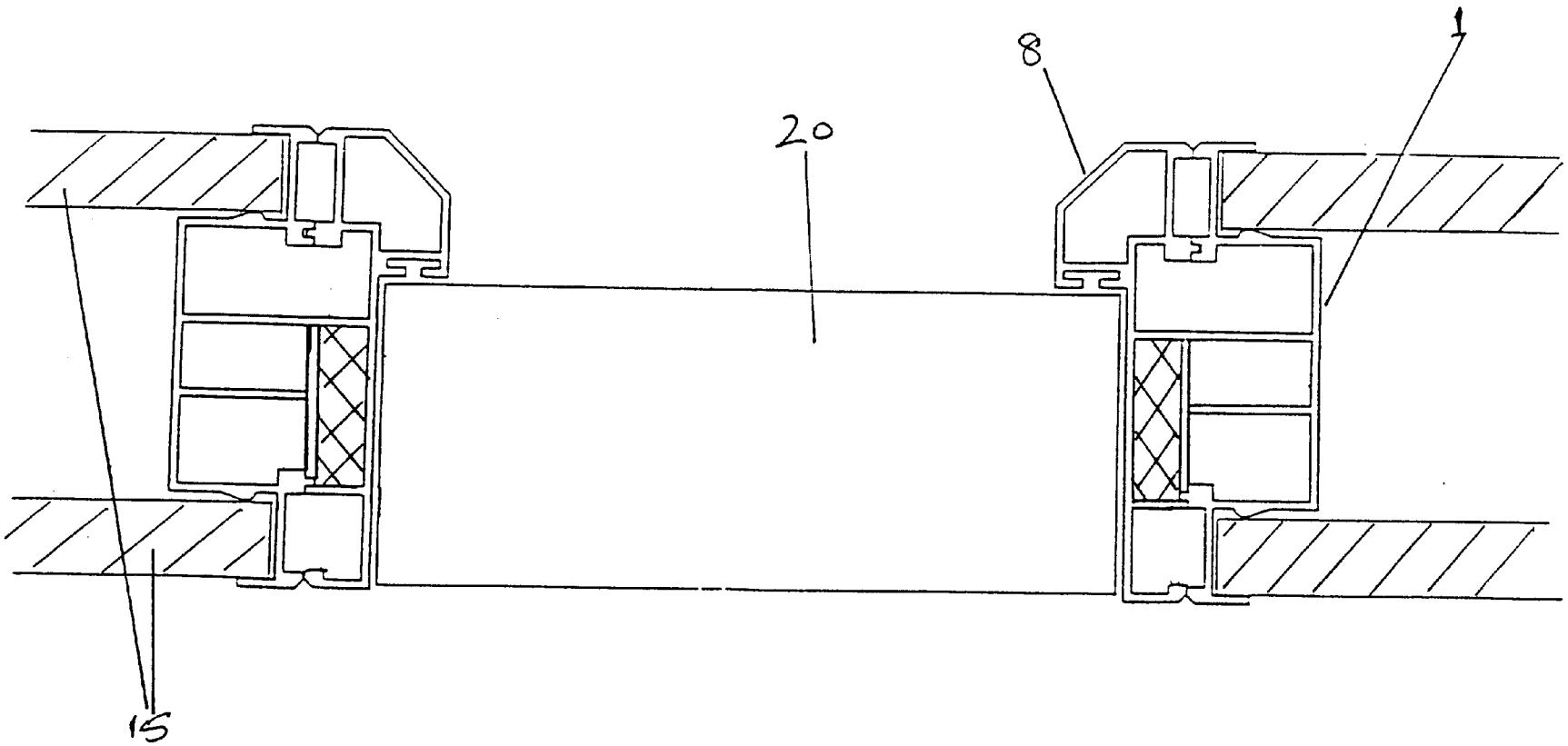
FIG. 11 is a transverse sectional view of a door unit between two adjacent partition panels.
Figure 12:
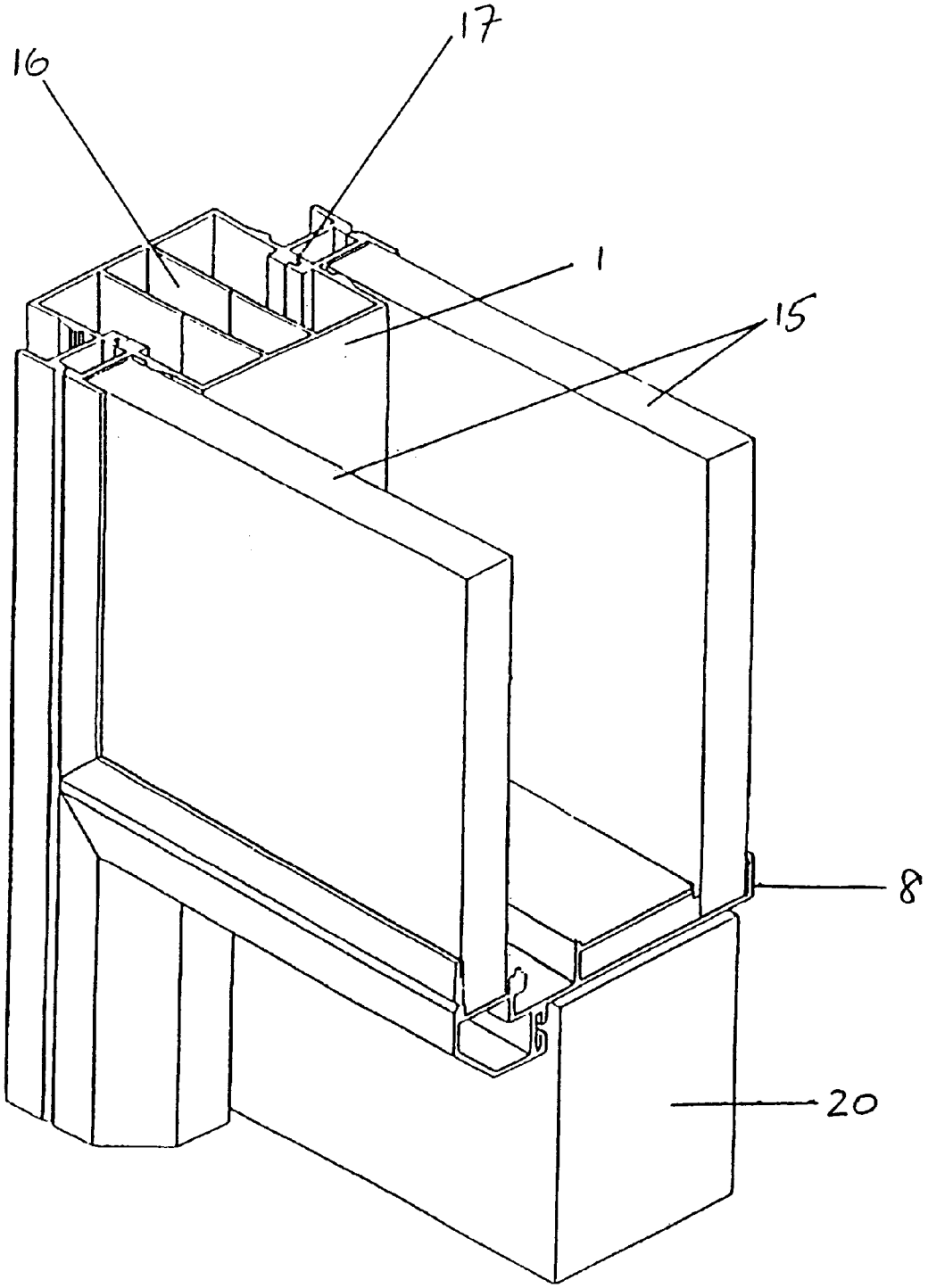
FIG. 12 is perspective view of a section of the door with the partition panels.

The door framework (8) can be seen in FIG. 3, which shows the recess for the partition panels (9) and the recess for the cabling (9A). The door framework surrounds the door on 2 sides. The open face of the door framework can either interconnect with the open face of the vertical framework surrounding the door as can be seen in FIG. 1 1, or receive the partition panels directly into the recess (9), as can be seen in FIG. 12. The recess (9A) in the door framework enables an internal conduit to be created (16). The door (20) is attached to the rectangular cross section member of the door framework.

Where two partition walls meet to form a corner the open face of the vertical framework can be concealed from view by the use of a suitable cover (19) as seen in FIG. 10.

Figure 5:
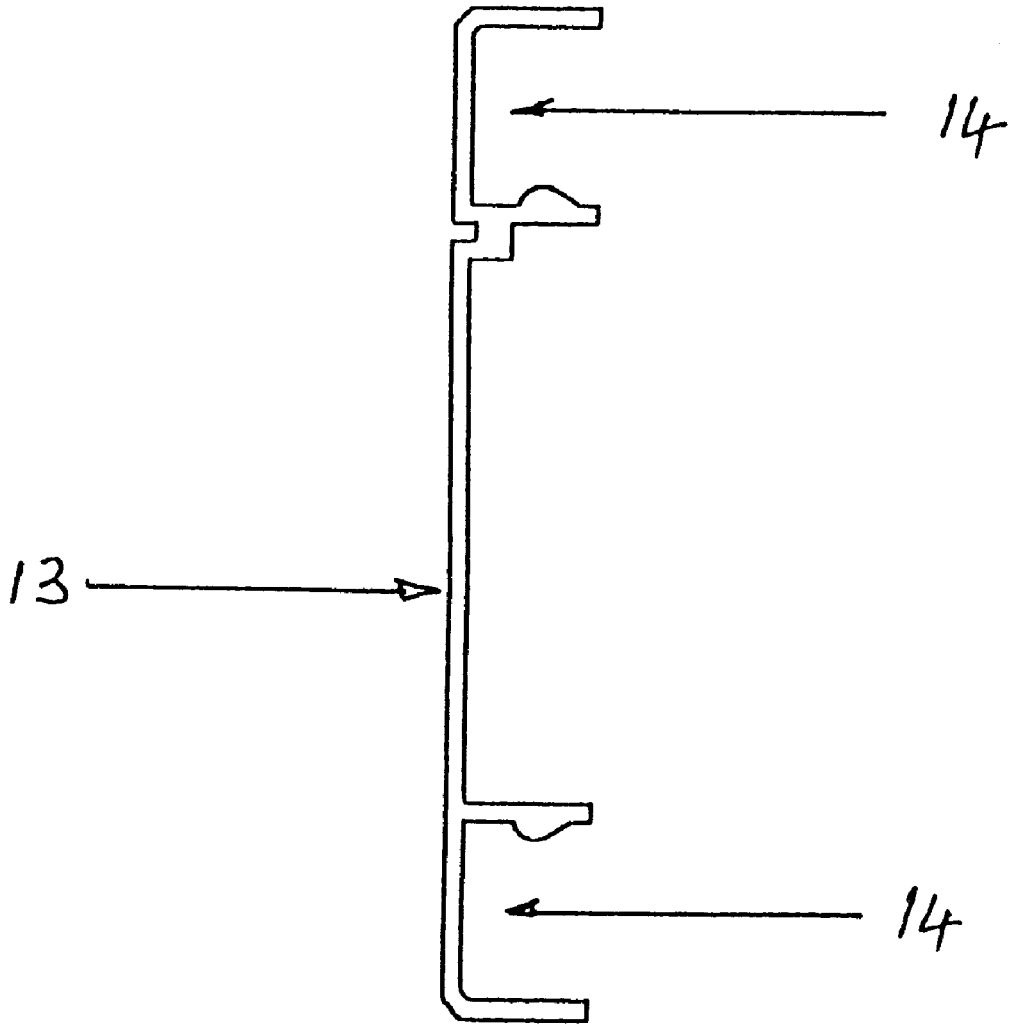
FIG. 5 is a transverse sectional view of the covering framework

On arrival at the site covering framework (FIG. 5) is secured to the wall at the desired location. Brackets are then attached at the appropriate locations on to the floor and the wall.

The perpendicular retaining pins of the bracket, which lie in a horizontal plane when attached to the wall, interconnect with the channels of the covering framework disposed at the top horizontal surface of the partitioning panels.

Once the brackets are attached to the floor the entire prefabricated panel system can be fitted on the perpendicular pins of the brackets on the floor. The open face of adjacent partition panels interlock (17) as seen in FIG. 7, to give stability to the partition wall.

What is claimed is:

1. A method of partitioning an office space, comprising the steps of:

providing an interlocking framework unit including at least one vertical framework configured to receive and support at least one partitioning material, at least one skirting framework configured to receive and support at least one partitioning material, at least one covering framework configured to receive and support at least one partitioning material, at least one window framework configured to receive and support at least one of at least one partitioning material and at least one window and at least one door framework configured to receive and support at least one of at least one partitioning material and at least one door; the interlocking framework unit being configured to form at least one internal conduit for plural cables between adjacent partitioning materials from a ceiling level through the at least one skirting framework positioned at a floor level when assembled; and assembling the interlocking framework unit such that the at least one internal conduit is formed between the adjacent partitioning materials from the ceiling level through the at least one skirting framework positioned at a floor level;

wherein the at least one vertical framework comprises a U shaped channel formed by two side walls and a bottom wall, has two projecting members projecting perpendicularly from the bottom wall inwardly with respect to the U shaped channel so as to create a plurality of distinct channels within the U shaped channel, has an inverted L shaped member respectively disposed on the two side walls outwardly so as to create an external channel configured to receive a partitioning material, and has means for interlocking with an adjacent one of the at least one vertical, skirting, covering, window and door frameworks.

2. A method of partitioning an office space as claimed in claim 1, wherein the at least one covering framework comprises a U shaped channel formed by two side walls and a bottom wall, has two projection members projecting perpendicularly from the bottom wall inwardly with respect to the U shape channel so as to create two channels each configured to receive a partitioning material, and has means for interlocking with an adjacent one of the at least one vertical, skirting, covering, window and door frameworks.

3. A method of partitioning an office space as claimed in claim 1, wherein the at least one window framework comprises a rectangular cross-section member having a wing member at each of two sides in two longitudinal ends of a rectangular cross-section of the rectangular cross-section member, the wing members each being configured to receive a partitioning material, the rectangular cross-section member having a channel cut out so as to receive a glass for the at least one window, the rectangular cross-section member having means for interlocking with an adjacent one of the at least one vertical, skirting, covering, window and door frameworks.

4. A method of partitioning an office space as claimed in claim 1, wherein the at least one door framework comprises a rectangular cross-section member having means for interlocking with an adjacent one of the at least one vertical, skirting, covering, window and door frameworks, the rectangular cross-section member having a channel cut out at each of two sides in two longitudinal ends of a rectangular cross-section of the rectangular cross-section member, one of the two channels being configured to receive a partitioning material, and a tubular cross-section member having a recess configured to receive a partitioning material, the tubular cross-section member being attached to the rectangular cross-section member such that the recess of the tubular cross-section member is parallel to the two channels cut out in the rectangular cross-section member.

5. A method of partitioning an office space as claimed in claim 1, further comprising placing two partitioning materials parallel to each other with vertical edges of the two partitioning materials inserted into the at least one vertical framework.

6. A method of partitioning an office space as claimed in claim 1, further comprising securing at least one partitioning material by means of brackets attached to a floor, wherein the brackets are disposed with means to interlock with the at least one vertical framework.

7. A method of partitioning an office space as claimed in claim 1, wherein the at least one skirting framework is configured to be attached to a bottom portion of the at least one vertical framework.

8. A method of partitioning an office space as claimed in claim 1, wherein the at least one vertical framework has at least one opening configured to run the plural cables to the at least one skirting framework.

9. A method of partitioning an office space as claimed in 1, wherein the at least one vertical framework includes at least one internal bracing member configured to brace the at least one partitioning material.

10. A method of partitioning an office space as claimed in 1, wherein the at least one skirting framework includes at least one junction box configured to receive the plural cables from the at least one vertical framework.

11. A method of partitioning an office space as claimed in 1, wherein the at least one skirting framework is configured to be bolted to a floor.

12. A method of partitioning an office space, comprising the steps of:

providing an interlocking framework unit including at least one vertical framework configured to receive and support at least one partitioning material, at least one skirting framework configured to receive and support at least one partitioning material, at least one covering framework configured to receive and support at least one partitioning material, at least one window framework configured to receive and support at least one of at least one partitioning material and at least one window and at least one door framework configured to receive and support at least one of at least one partitioning material and at least one door; the interlocking framework unit being configured to form at least one internal conduit for plural cables between adjacent partitioning materials from a ceiling level through the at least one skirting framework positioned at a floor level when assembled; and assembling the interlocking framework unit such that the at least one internal conduit is formed between the adjacent partitioning materials from the ceiling level through the at least one skirting framework positioned at a floor level;

wherein the at least one skirting framework comprises a U shaped channel formed by two side walls and a bottom wall, has two projecting members projecting perpendicularly from the bottom wall inwardly with respect to U shaped channel, has two L shaped members each extending from a respective one of edge portions of one of the two side walls, and has two rectangular channels each provided at a respective one of end portions of other one of the two side walls, the two L shaped members each being configured to receive a skirting cover configured to cover a respective opening between the two rectangular channels and the two L shape members, the two rectangular channels each being configured to receive a partitioning material.

13. A method of partitioning an office space as claimed in claim 12, wherein the at least one covering framework comprises a U shaped channel formed by two side walls and a bottom wall, has two projection members projecting perpendicularly from the bottom wall inwardly with respect to the U shape channel so as to create two channels each configured to receive a partitioning material, and has means for interlocking with an adjacent one of the at least one vertical, skirting, covering, window and door frameworks.

14. A method of partitioning an office space as claimed in claim 12, wherein the at least one window framework comprises a rectangular cross-section member having a wing member at each of two sides in two longitudinal ends of a rectangular cross-section of the rectangular cross-section member, the wing members each being configured to receive a partitioning material, the rectangular cross-section member having a channel cut out so as to receive a glass for the at least one window, the rectangular cross-section member having means for interlocking with an adjacent one of the at least one vertical, skirting, covering, window and door frameworks.

15. A method of partitioning an office space as claimed in 12, wherein the at least one door framework comprises a rectangular cross-section member having means for interlocking with an adjacent one of the at least one vertical, skirting, covering, window and door frameworks, the rectangular cross-section member having a channel cut out at each of two sides in two longitudinal ends of a rectangular cross-section of the rectangular cross-section member, one of the two channels being configured to receive a partitioning material, and a tubular cross-section member having a recess configured to receive a partitioning material, the tubular cross-section member being attached to the rectangular cross-section member such that the recess of the tubular cross-section member is parallel to the two channels cut out in the rectangular cross-section member.

16. A method of partitioning an office space as claimed in claim 12, further comprising placing two partitioning materials parallel to each other with vertical edges of the two partitioning materials inserted into the at least one vertical framework.

17. A method of partitioning an office space as claimed in claim 12, further comprising securing at least one partitioning material by means of brackets attached to a floor, wherein the brackets are disposed with means to interlock with the at least one vertical framework.

18. A method of partitioning an office space as claimed in claim 12, wherein the at least one skirting framework is configured to be attached to a bottom portion of the at least one vertical framework.

19. A method of partitioning an office space as claimed in claim 12, wherein the at least one vertical framework has at least one opening configured to run the plural cables to the at least one skirting framework.

20. A method of partitioning an office space as claimed in 12, wherein the at least one vertical framework includes at least one internal bracing member configured to brace the at least one partitioning material.

21. A method of partitioning an office space as claimed in 12, wherein the at least one skirting framework includes at least one junction box configured to receive the plural cables from the at least one vertical framework.

22. A method of partitioning an office space as claimed in 12, wherein the at least one skirting framework is configured to be bolted to a floor.

23. An interlocking framework unit, comprising:

at least one vertical framework configured to receive and support at least one partitioning material;

at least one skirting framework configured to receive and support the at least one partitioning material;

at least one covering framework configured to receive and support the at least one partitioning material;

at least one window framework configured to receive and support at least one of the at least one partitioning material and at least one window; and at least one door framework configured to receive and support at least one of at least one partitioning material and at least one door;

wherein:

the interlocking framework unit is configured to form at least one internal conduit for plural cables between adjacent partitioning materials from a ceiling level through the at least one skirting framework positioned at a floor level; and the at least one vertical framework comprises a U shaped channel formed by two side walls and a bottom wall, has two projecting members projecting perpendicularly from the bottom wall inwardly with respect to the U shaped channel so as to create a plurality of distinct channels within the U shaped channel, has an inverted L shaped member respectively disposed on the two side walls outwardly so as to create an external channel configured to receive a partitioning material, and has means for interlocking with an adjacent one of the at least one vertical, skirting, covering, window and door frameworks.

24. An interlocking framework unit as claimed in claim 23, wherein the at least one covering framework comprises a U shaped channel formed by two side walls and a bottom wall, has two projection members projecting perpendicularly from the bottom wall inwardly with respect to the U shape channel so as to create two channels each configured to receive a partitioning material, and has means for interlocking with an adjacent one of the at least one vertical, skirting, covering, window and door frameworks.

25. An interlocking framework unit as claimed in claim 23, wherein the at least one window framework comprises a rectangular cross-section member having a wing member at each of two sides in two longitudinal ends of a rectangular cross-section of the rectangular cross-section member, the wing members each being configured to receive a partitioning material, the rectangular cross-section member having a channel cut out so as to receive a glass for the at least one window, the rectangular cross-section member having means for interlocking with an adjacent one of the at least one vertical, skirting, covering, window and door frameworks.

26. An interlocking framework unit as claimed in claim 23, wherein the at least one door framework comprises a rectangular cross-section member having means for interlocking with an adjacent one of the at least one vertical, skirting, covering, window and door frameworks, the rectangular cross-section member having a channel cut out at each of two sides in two longitudinal ends of a rectangular cross-section of the rectangular cross-section member, one of the two channels being configured to receive a partitioning material, and a tubular cross-section member having a recess configured to receive a partitioning material, the tubular cross-section member being attached to the rectangular cross-section member such that the recess of the tubular cross-section member is parallel to the two channels cut out in the rectangular cross-section member.

27. An interlocking framework unit, comprising:

at least one vertical framing means for receiving and supporting at least one partitioning material;

at least one skirting means for receiving and supporting a bottom portion of the at least one partitioning material on a floor;

at least one window framing means for receiving and supporting at least one of the at least one partitioning material and at least one window;

at least one door framing means for receiving and supporting at least one of at least one partitioning material and at least one door; and at least one covering means for receiving and supporting the at least one partitioning material;

wherein:

the interlocking framework unit forms at least one internal conduit for plural cables between adjacent partitioning materials from a ceiling level through the at least one skirting means positioned at a floor level; and the at least one vertical framing means comprises a U shaped channel formed by two side walls and a bottom wall, has two projecting members projecting perpendicularly from the bottom wall inwardly with respect to the U shaped channel so as to create a plurality of distinct channels within the U shaped channel, has an inverted L shaped member respectively disposed on the two side walls outwardly so as to create an external channel configured to receive a partitioning material, and has means for interlocking with an adjacent one of the at least one vertical framing, skirting, covering, window framing and door framing means.

28. An interlocking framework unit, comprising:

at least one vertical framework configured to receive and support at least one partitioning material;

at least one skirting framework configured to receive and support the at least one partitioning material;

at least one covering framework configured to receive and support the at least one partitioning material;

at least one window framework configured to receive and support at least one of the at least one partitioning material and at least one window; and at least one door framework configured to receive and support at least one of at least one partitioning material and at least one door;

wherein the interlocking framework unit is configured to form at least one internal conduit for plural cables between adjacent partitioning materials from a ceiling level through the at least one skirting framework positioned at a floor level; and the at least one skirting framework comprises a U shaped channel formed by two side walls and a bottom wall, has two projecting members projecting perpendicularly from the bottom wall inwardly with respect to the U shaped channel, has two L shaped members each extending from a respective one of edge portions of one of the two side walls, and has two rectangular channels each provided at a respective one of end portions of other one of the two side walls, the two L shaped members each being configured to receive a skirting cover configured to cover a respective opening between the two rectangular channels and the two L shape members, the two rectangular channels each being configured to receive a partitioning material.

29. An interlocking framework unit as claimed in claim 28, wherein the at least one covering framework comprises a U shaped channel formed by two side walls and a bottom wall, has two projection members projecting perpendicularly from the bottom wall inwardly with respect to the U shape channel so as to create two channels each configured to receive a partitioning material, and has means for interlocking with an adjacent one of the at least one vertical, skirting, covering, window and door frameworks.

30. An interlocking framework unit as claimed in claim 28, wherein the at least one window framework comprises a rectangular cross-section member having a wing member at each of two sides in two longitudinal ends of a rectangular cross-section of the rectangular cross-section member, the wing members each being configured to receive a partitioning material, the rectangular cross-section member having a channel cut out so as to receive a glass for the at least one window, the rectangular cross-section member having means for interlocking with an adjacent one of the at least one vertical, skirting, covering, window and door frameworks.

31. An interlocking framework unit as claimed in claim 28, wherein the at least one door framework comprises a rectangular cross-section member having means for interlocking with an adjacent one of the at least one vertical, skirting, covering, window and door frameworks, the rectangular cross-section member having a channel cut out at each of two sides in two longitudinal ends of a rectangular cross-section of the rectangular cross-section member, one of the two channels being configured to receive a partitioning material, and a tubular cross-section member having a recess configured to receive a partitioning material, the tubular cross-section member being attached to the rectangular cross-section member such that the recess of the tubular cross-section member is parallel to the two channels cut out in the rectangular cross-section member.

* * * * *